United States Patent [19]

Codd

[11] Patent Number: 4,704,836

[45] Date of Patent: Nov. 10, 1987

[54] SPACE FRAMES

[75] Inventor: Edwin T. Codd, Brisbane, Australia

[73] Assignee: Tulserate Limited, London, England

[21] Appl. No.: 829,658

[22] PCT Filed: May 30, 1985

[86] PCT No.: PCT/AU85/00114

§ 371 Date: Jan. 23, 1986

§ 102(e) Date: Jan. 23, 1986

[87] PCT Pub. No.: WO85/05650

PCT Pub. Date: Dec. 19, 1985

[30] Foreign Application Priority Data

May 31, 1984 [AU] Australia ..... PG5295

[51] Int. Cl.[4] ..... E04B 1/19; E04B 1/58

[52] U.S. Cl. ..... 52/650; 52/655

[58] Field of Search ..... 52/650, 648, 655; 403/172

[56] References Cited

U.S. PATENT DOCUMENTS 3,443,348 5/1969 Papayoti ..... 52/648

4,438,616 3/1984 Codd ..... 52/650

FOREIGN PATENT DOCUMENTS

72821/81 8/1984 Australia .

32185/84 3/1985 Australia .

895191 11/1982 Belgium .

2625599 12/1977 Fed. Rep. of Germany .

*Primary Examiner*—John E. Murtagh

*Attorney, Agent, or Firm*—Schwartz, Jeffery, Schwaab, Mack, Blumenthal & Evans

[57] ABSTRACT

In a space frame of the type having upper and lower grids of tubular longitudinal and lateral chord members, (10, 11), the nodes or intersections of chords (10, 11) of the upper and lower grid being interconnected by oblique struts (14), the chords (10, 11) are flattened at each intersection and overlapped, the struts (14), which are also tubular, being flattened and deformed at their ends to form attachment pads (15), bolts (17) connecting the attachment pads (15) and overlapped flattened chord sections (12) and also load distribution plates (19, 20, 21, 22) of which one (22) has side edges abutting against shoulders or abutments (16) on the struts (14) adjacent to the attachment pads (15), and others (19, 20, 21) have corner portions bearing on the ends of the top and bottom of the flattened sections (12) of the chord members.

10 Claims, 6 Drawing Figures

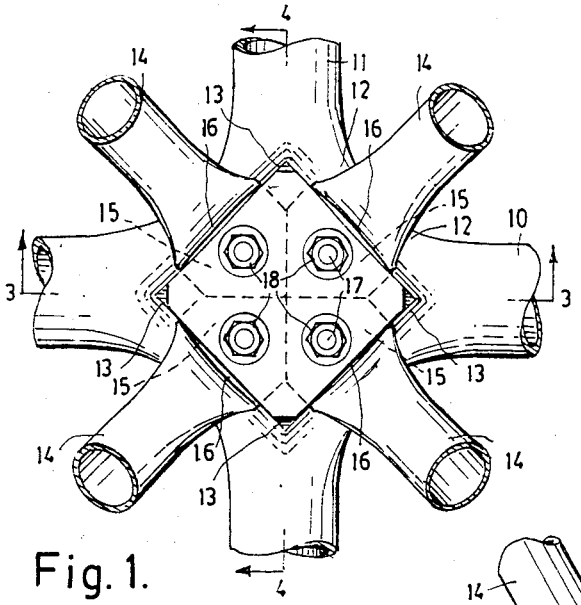
Fig. 1.
Fig. 3.
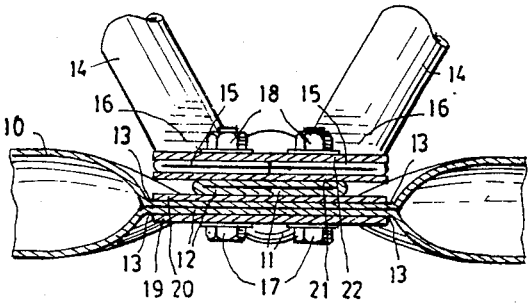
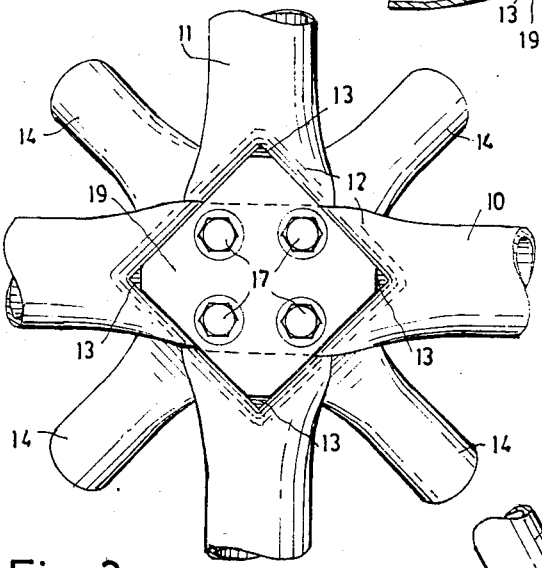
Fig. 2.
Fig. 4.
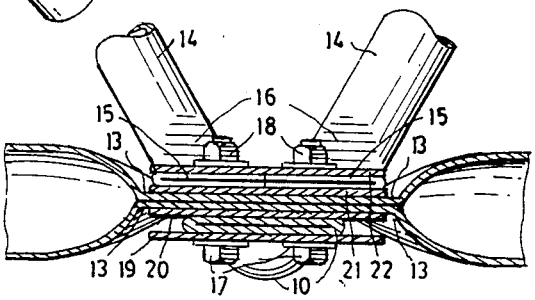

SPACE FRAMES

BACKGROUND OF THE INVENTION (1) Field of the Invention

This invention relates to space frames.

(2) Brief Description of the Prior Art

Where constructions of shallow depth are required to be erected over wide spans with a minimum number of supports and with a minimum of elastic movement under load, space frames are usually considered most appropriate. In most cases a space frame is of double-layer type, comprising upper and lower grids of longitudinal and lateral members or chords, the junctions of chords, or nodes, of the upper and lower grid being interconnected by oblique web members or struts. Usually the lower grid is displaced both longitudinally and laterally relative to the upper grid so that each node of the lower grid is exuidistant from four nodes of the upper grid, and is connected to them by four oblique struts. In some space frames, however, the nodes of the lower grid are directly below those of the upper grid so that the axes of the oblique struts are in the axes of the chords they interconnect, and additional vertical struts may interconnect corresponding nodes of the two grids.

Space frames may be modified for the construction of tunnel-vaulted, rather than flat, structures.

A disadvantage of many space frame constructions presently in use is that expensive connectors are used to interconnect chord and strut members at each node, and the fixture of the members to the connectors requires a good deal of time and skilled labour.

SUMMARY OF THE PRESENT INVENTION

The present invention has been devised with the general object of providing a space frame which is simple and economical to manufacture and erect without requiring any costly or elaborate means for interconnecting the space frame members at its nodes. Another object is to provide such a space frame which may be of either of the types mentioned, that is, with each lower grid node connected by similar oblique struts to four nodes of the upper grid, or with the upper and lower grids interconnected by oblique struts in the planes of the interconnected chords of the two grids.

With the foregoing and other objects in view the invention resides broadly in a space frame of the type having upper and lower grids of tubular longitudinal and lateral chord members and oblique struts with attachment pads at their ends interconnecting nodes at chord intersections of the two grids wherein, at each node:

the chord members have flattened sections in superimposed relationship, strut attachment pads are flattened and secured in adjacent substantially co-planar relationship to the superimposed flattened chord sections, load distribution plates are provided including such plates disposed above and below the assembly of adjacent strut attachment pads and superimposed flattened chord sections, and the said parts are interconnected by a plurality of fastening means each through the load distribution plates, the flattened chord sections and one of the strut attachment pads.

Preferably the fastening means comprise bolts and nuts, and the load distribution plates include one above, one below and one between the superimposed flattened chord sections. Other features of the invention will become apparent from the following description.

BRIEF DESCRIPTION OF THE DRAWINGS

In the drawings:

FIG. 1 is a top view of a node of the lower grid of a space according to the invention, FIG. 2 is a bottom view of the node shown in FIG. 1, FIG. 3 is a sectional view along line 3—3 in FIG. 1, FIG. 4 is a sectional view along line 4—4 in FIG. 1.

DETAILED DESCRIPTION OF THE PREFERRED EMBODIMENTS

Figure 5:
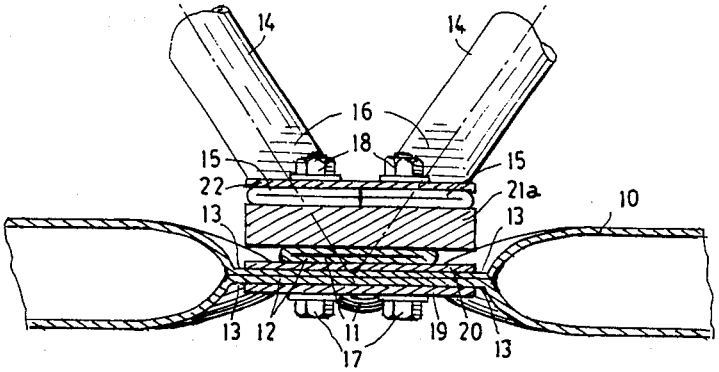
FIG. 5 is a sectional view of a modified space frame node.

Referring initially to FIGS. 1 to 5 of the drawings, a space frame, of which one node only is shown, consists of upper and lower grids of tubular longitudinal and lateral chords intersecting at nodes, similar oblique tubular struts interconnecting the nodes of the two grids. The node shown in the drawings is of the lower grid, at which a longitudinal chord 10 is crossed perpendicularly by a lateral chord 11, both tubular chords being flattened, and therefore widened, at the node.

Each of the chords is flattened in such a way that the top and bottom of the flattened and widened section 12 terminates at each end in a V-shaped or right-angled depression 13. Four bolt holes are formed through each flattened section 12.

Each of the oblique struts 14, of lesser diameter than the chords 10 and 11, has each end flattened or deformed in such manner that the flattened extremity is well off-set from the axis of the tube and is bent along a transverse line through an acute angle to form an attachment pad 15, the end of which is mitred or cut away at an angle of about 45° from both sides and is formed with a bolt hole. Owing to the off-set formation of the strut attachment pads 15 and the angle through which they are bent, each strut 14 is formed with a transverse shoulder or abutment 16 adjacent to each attachment pad 15.

Four bolts 17 with nuts 18 are used to connect rigidly together the two chords 10 and 11 and the four struts 14, together with four load distribution plates. All of the load distribution plates are square with cutaway corners, and with four bolt holes,and comprise a first plate 19; a second plate 20; a third plate indicated at 21 in FIGS. 1 to 4, and, in modified form, at 21*a* in FIG. 5; and a fourth plate 22.

The four bolts 17 are passed up through the bolt holes of the first load distribution plate 19, the registering bolt holes in the flattened section 12 of the chord 10, the bolt holes of the second plate 20, the bolt holes of the flattened section 12 of the lateral chord 11, the aligned bolt holes of the third plate 21 (FIGS. 3 and 4) or 21*a* (FIG. 5), the bolt holes of the four strut attachment pads 15, and the bolt holes of the fourth load distribution plate 22, the nuts 18 then being screwed tightly onto the bolts 17.

The flattened section 12 of the longitudinal chord 10 is then reinforced by the first and second load distribution plates 19 and 20, opposite corners of which seat firmly in the V-shaped depressions 13 of the top and bottom of this section, and similarly the second and third plates 20 and 21 reinforce the flattened section 12 of the lateral chord 11. The mitred edges of the attachment pads 15 of the four struts 14 are held in closely abutting adjacent arrangement, as indicated by broken lines in FIG. 1, and the four sides of the fourth load distribution plate 22 bear firmly against the shoulders or abutments 16 of the four struts 14.

The third load distribution plate 21*a* of the modification shown in FIG. 5 is of such increased thickness that the axes of the four oblique struts 14 meet close to the axes of the chord members. If it is desired that the axes of the longitudinal and lateral chords should lie in the one plane, their flattened sections 12 may be appropriately off-set.

The nodes of the upper grid of the space frame are inverted, relative to the bottom grid node illustrated, but are otherwise similar; except that a single strut 14 is fixed to each corner node of the upper grid, and two struts lead into each node along the sides of the upper grid.

Figure 6:
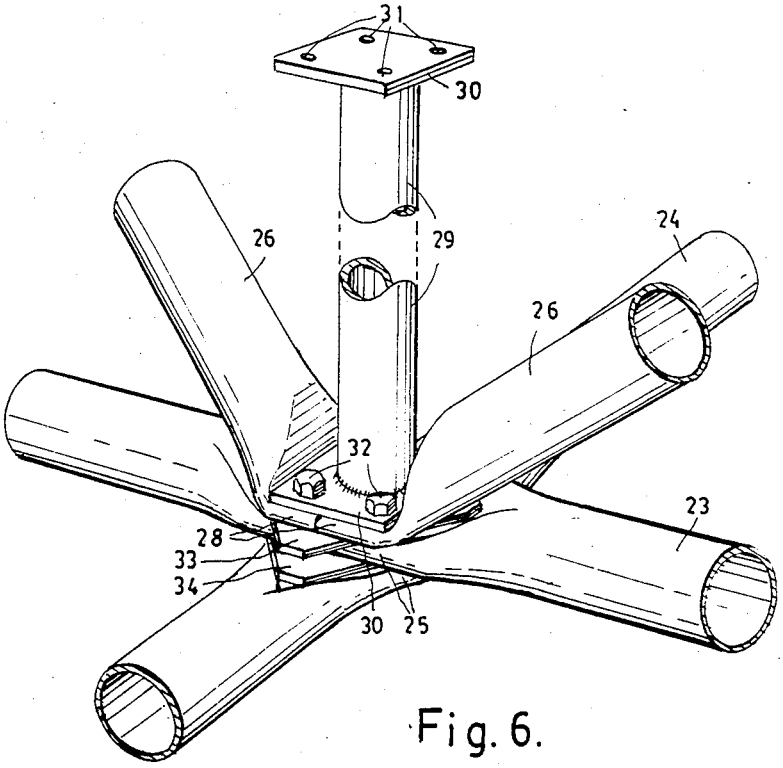
FIG. 6 is a perspective view of a lower grid node according to another embodiment of the invention.

The embodiment shown in FIG. 6 of the drawings is a node of the lower grid of a space frame of the type in which the axes of the struts lie in the planes of the chords they interconnect. A tubular longitudinal chord 23 and a similar lateral chord 24 have flattened sections 25 similar to those before described. Two oblique struts 26 have their extremities flattened, the flattened parts of each being off-set from the strut axis to form an adjacent shoulder or abutment 27, the flattened part then being bent through an angle to form an attachment pad 28 with a square-cut end. There is also provided a vertical strut 29 with an attachment plate 30, formed with bolt holes 31, welded to each end. Bolts 32 are passed through the bolt holes 31 of an attachment plate 30, through registering bolt holes in the abutting attachment pads 28, in an upper load distribution plate 33, in the flattened section 25 of the longitudinal chord 23, in a middle load distribution palte 34, in the flattened section 25 of the lateral chord 24 and in a bottom load distribution plate (not shown), the bolts then being engaged by nuts (not shown). The three load distribution plates are similar to those illustrated in FIGS. 1 to 4 and similarly engage and reinforce the flattened sections of the chords.

Space frames according to the invention will be found to be very easily and economically assembled and, because of the strength and torsional stability of each node, to be very effective in achieving the objects for which they have been devised.

I claim:

1. A space frame of the type having upper and lower grids of tubular longitudinal and lateral chord members, and tubular oblique struts with attachment pads at their ends interconnecting nodes at chord intersections of the two grids wherein, at each node:

the chord members have flattened sections in sumperimposed relationship, strut attachment pads are flattened to form shoulders adjacent ot the pad and are secured, in adjacent substantially co-planar relationship, to the superimposed flattened chord sections, load distribution plates are provided disposed above and below the assembly of adjacent strut attachment pads and superimposed flattened chord sections, the distribution plate secured to said attachment pads having side edges which bear against said shoulders, the chord members, pads, and plates are interconnected by a plurality of fastening means each extending through the load distribution plates, the flattened chord sections and one of the strut attachment pads; and wherein at least two of said fastening means pass through each of said flattened cord sections to strengthen the node.

2. A space frame according to claim 1 wherein the load distribution plate interposed between the strut attachment pads and the flattened lateral chord section is of such thickness that the prolongations of the axes of the struts meet at a point within the overlapping chord sections.

3. A space frame acccording to claim 1 wherein the axis of each of the obilique struts lies substantially in the vertical plane through the axes of the parallel chords the said struts interconnect.

4. A space frame according to claim 1 wherein the load disribution plate secured on the strut attachment pads is secured in an end of a vertical strut of the space frame.

5. A space frame of the type having upper and lower grids of tubular longitudinal and lateral chord members, and oblique struts with attachment pads at their ends interconnecting nodes at chord intersections of the two grids wherein, at each node:

the chord members have flattened sections in superimposed relationship, strut attachment pads are flattened and secured, in adjacent substantially co-planar relationship in which the side edges of adjacent pads abut, to the superimposed flattened chord sections, load distribution plates are provided disposed above and and below the assembly of adjacent strut attachment pads and superimposed flattened chord sections, the chord members, pads, and plates are interconnected by a plurality of fastening means each extending through the load distribution plates, the flattened chord sections and one of the strut attachment pads, and wherein at least two of said fastening means pass through each of said flattened cord sections to strengthen the node.

6. A space frame of the type having upper and lower grids of tubular longitudinal and lateral chord members, and oblique struts with attachment pads at their ends interconnecting nodes at chord intersections of the two grids wherein, at each node:

the chord members have flattened sections in superimposed relationship, strut attachment pads are flattened and secured, in adjacent substantially co-planar relationship, to the superimposed flattened chord sections, load distribution plates are provided disposed above and below the assembly of adjacent strut attachment pads and superimposed flattened chord sections, the flattened section of chord terminates at each end in V-shaped depressions above and below the chord, the load distribution plates above and below each of said flattened sections being formed with opposed corner portions bearing in each of the said V-shaped depressions, the chord members, pads, and plates are interconnected by a plurality of fastening means each extending through the load distribution plates, the flattened chord sections and one of the strut attachment pads, and wherein at least two of said fastening means pass through each of said flattened cord sections to strengthen the node.

7. A space frame of the type having upper and lower grids of tubular longitudinal and lateral chord members, and oblique struts with strut attachment pads at their ends interconnecting nodes at chord intersections of the two grids wherein, at each node:

the chord members have flattened sections in superimposed relationship, the strut attachment pads are flattened and secured, in adjacent substantially co-planar relationship, to the superimposed flattened chord sections, a plurality of load distribution plates, a first pair of plates being disposed asbove and below said adjacent co-planar strut attachment pads, a second pair of plates being disposed above and below said longitudinal chord section, the plate below said strut attachment pads and the plate above said longitudinal chord section being positioned respectively above and below said lateral chord section, the chord members, pads, and plates are interconnected by a plurality of fastening means each extending through the load distribution plates, the flattened chord sections and one of the strut attachment pads, and wherein at least two of said fastening means pass through each of said flattened chord sections to strengthen the node.

8. A space frame according to claim 7 wherein the load distribution plate interposed between the strut attachment pads and the flattened lateral chord section is of such thickness thaat the prolongations of the axes of the struts meet at a point within the overlapping chord sections.

9. A space frame according to claim 7 wherein the axis of each of the oblique struts lies substantially in the vertical plane through the axes of the parallel chords the said struts interconnect.

10. A space frame according to claim 7 wherein the load distribution plate secured on the strut attachment pads is secured in an end of a vertical strut of the space frame.

* * * * *